US009850701B1

(12) United States Patent
Arway et al.

(10) Patent No.: US 9,850,701 B1
(45) Date of Patent: Dec. 26, 2017

(54) DOOR WITH IMPACT RESISTANT LIGHT

(71) Applicant: Schlage Lock Company LLC, Carmel, IN (US)

(72) Inventors: David L. Arway, Cincinnati, OH (US); Karen Bishop, Cincinnati, OH (US); David J. Wells, Cincinnati, OH (US); Lance W. Graff, Cincinnati, OH (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 15/342,688

(22) Filed: Nov. 3, 2016

(51) Int. Cl.

| | |
|---|---|
| ***E06B 5/12*** | (2006.01) |
| ***E06B 3/58*** | (2006.01) |
| ***E06B 3/66*** | (2006.01) |
| ***E06B 3/82*** | (2006.01) |

(52) U.S. Cl.
CPC ..... *E06B 5/12* (2013.01); *E06B 3/5892* (2013.01); *E06B 3/66* (2013.01); *E06B 3/827* (2013.01)

(58) Field of Classification Search
CPC ..... E06B 5/12; E06B 3/827; E06B 3/5892; E06B 3/66; E06B 5/10; E06B 5/11
See application file for complete search history.

(56) References Cited

U.S. PATENT DOCUMENTS

| | | | | |
|---|---|---|---|---|
| 5,636,484 | A * | 6/1997 | DeBlock | E06L 33/5892 52/171.1 |
| 6,546,682 | B1 * | 4/2003 | DeBlock | E32B 17/10 52/504.68 |
| 6,675,550 | B1 | 1/2004 | Dlubak | |
| 7,793,581 | B2 * | 9/2010 | Erskine | B32L 317/1003 89/36.04 |
| 8,297,007 | B2 | 10/2012 | Sayer | |
| 8,789,324 | B2 | 7/2014 | Hay et al. | |
| 9,163,449 | B2 | 10/2015 | Weiss et al. | |
| 2007/0011962 | A1 * | 1/2007 | Erskine | B32L 317/1003 52/204.71 |
| 2008/0245003 | A1 | 10/2008 | Kon et al. | |
| 2009/0241422 | A1 * | 10/2009 | Mock | E06L 33/5892 49/197 |
| 2015/0038032 | A1 | 2/2015 | Pfau et al. | |
| 2016/0010386 | A1 | 1/2016 | Gouge et al. | |
| 2016/0060945 | A1 | 3/2016 | Weiss et al. | |

* cited by examiner

*Primary Examiner* — Patrick J Maestri
(74) *Attorney, Agent, or Firm* — Taft Stettinius & Hollister LLP

(57) ABSTRACT

An exemplary door includes a door body and a light assembly. The door body includes a first door panel defining a first panel opening, a second door panel defining a second panel opening, and an internal cavity. The area of the first panel is greater than the area of the second panel opening. The light assembly includes a first trim, a second trim, and an impact-resistant pane positioned in the door cavity. The first trim includes an outer frame coupled to the first door panel and an inner frame positioned in the internal cavity. The pane has an area greater than the area of the second panel opening area, and includes an first outer layer adhered to the inner frame of the first trim, a second outer layer adhered to the door body, and at least one intermediate layer.

23 Claims, 11 Drawing Sheets

DOOR WITH IMPACT RESISTANT LIGHT

TECHNICAL FIELD

The present disclosure generally relates to impact-resistant door lights, and more particularly but not exclusively relates to doors having such lights.

BACKGROUND

Metal doors occasionally include an enclosed window pane, often referred to as a "lite" or "light," in order to permit a user to view conditions on the opposite side of the door. Certain metal doors are intended for use in storm shelters, and are subjected to standardized testing to ensure that the door provides sufficient protection from flying debris that may be carried by high-velocity winds. When a light is installed in such a door, the light often represents a point of failure. For example, the impact may shatter the pane of the light, or may push the pane through the opening in the door skin. For these reasons among others, a need remains for further improvements in this technological field.

SUMMARY

An exemplary door includes a door body and a light assembly. The door body includes a first door panel defining a first panel opening, a second door panel defining a second panel opening, and an internal cavity. The area of the first panel is greater than the area of the second panel opening. The light assembly includes a first trim, a second trim, and an impact-resistant pane positioned in the door cavity. The first trim includes an outer frame coupled to the first door panel and an inner frame positioned in the internal cavity. The pane has an area greater than the area of the second panel opening area, and includes an first outer layer adhered to the inner frame of the first trim, a second outer layer adhered to the door body, and at least one intermediate layer. Further embodiments, forms, features, and aspects of the present application shall become apparent from the description and figures provided herewith.

DETAILED DESCRIPTION OF ILLUSTRATIVE EMBODIMENTS

Figure 1:
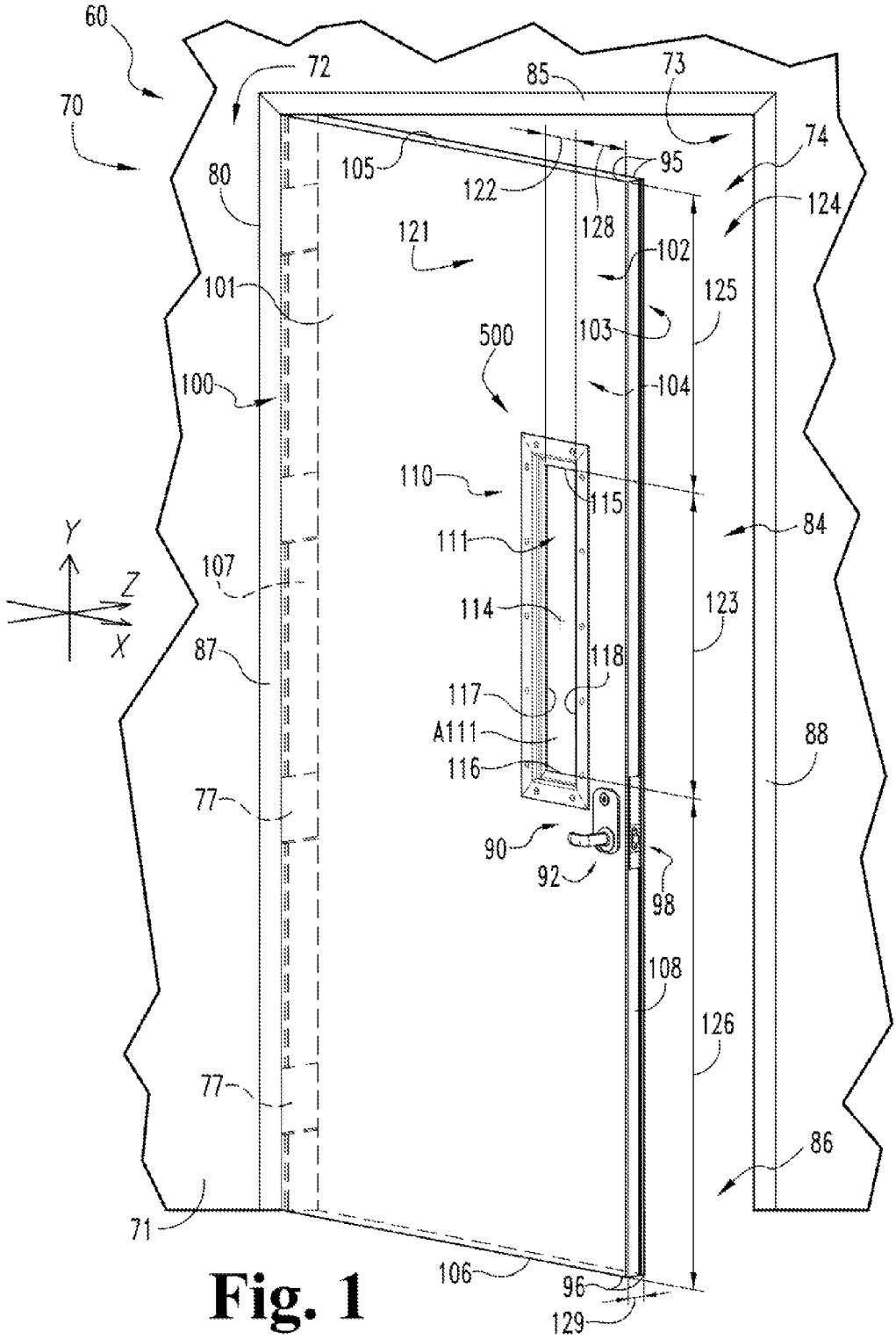
FIG. 1 illustrates a closure assembly including a door according to one embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

As used herein, the terms "longitudinal," "lateral," and "transverse" are used to denote motion or spacing along three mutually perpendicular axes, wherein each of the axes defines two opposite directions. For example, in the coordinate system illustrated in FIG. 2, the X-axis defines first and second lateral directions, the Y-axis defines first and second longitudinal directions, and the Z-axis defines first and second transverse directions. Additionally, the descriptions that follow may refer to the directions defined by the axes with specific reference to the orientations illustrated in the Figures. These terms are used for ease and convenience of description, and are without regard to the orientation of the system with respect to the environment. For example, descriptions that reference a longitudinal direction may be equally applicable to a vertical direction, a horizontal direction, or an off-axis orientation with respect to the environment.

Furthermore, motion or spacing along a direction defined by one of the axes need not preclude motion or spacing along a direction defined by another of the axes. For example, elements which are described as being "laterally offset" from one another may also be offset in the longitudinal and/or transverse directions, or may be aligned in the longitudinal and/or transverse directions. The terms are therefore not to be construed as limiting the scope of the subject matter described herein.

With reference to FIG. 1, illustrated therein is a closure assembly 60 installed in a structure such as a building 70. The building 70 includes a wall 71 which defines a boundary between a first region 72 and a second region 73, and the wall 71 has an opening 74 which connects the first and second regions 72, 73. The closure assembly 60 includes a frame 80, a door 100 pivotably mounted in the frame 80, and a latching assembly 90 mounted on the door 100. The frame 80 at least partially surrounds the opening 74, and defines a doorway 84 operable to receive the door 100. More specifically, the doorway 84 is defined by a top jamb 85, a floor 86 opposite the top jamb 85, a hinge jamb 87, and a latch jamb 88 opposite the hinge jamb 87.

The door 100 has a closed position defining a closed state of the closure assembly 60 and an open position defining an open state of the closure assembly 60. In the closed state, the door 100 is received in the doorway 84 and the latch assembly 90 is engaged with the frame 80. In the open state, the door 100 is not positioned in the doorway 84, thereby allowing persons to travel between the first and second regions 72, 73.

In the illustrated form, the first region 72 is an exterior region which may be exposed to adverse weather conditions such as hurricanes and/or tornadoes, and the second region 73 is an interior region intended to provide shelter from such adverse weather conditions. In certain forms, the exterior region 72 may be an outdoor region, and the interior region 73 may be an indoor region. In other forms, both the exterior and interior regions 72, 73 may be indoor regions, and the interior region 73 may be a designated shelter region. During adverse weather conditions, the exterior region 72 may be more likely than the interior region 73 to be exposed to flying debris carried by high-speed winds.

Figure 2:
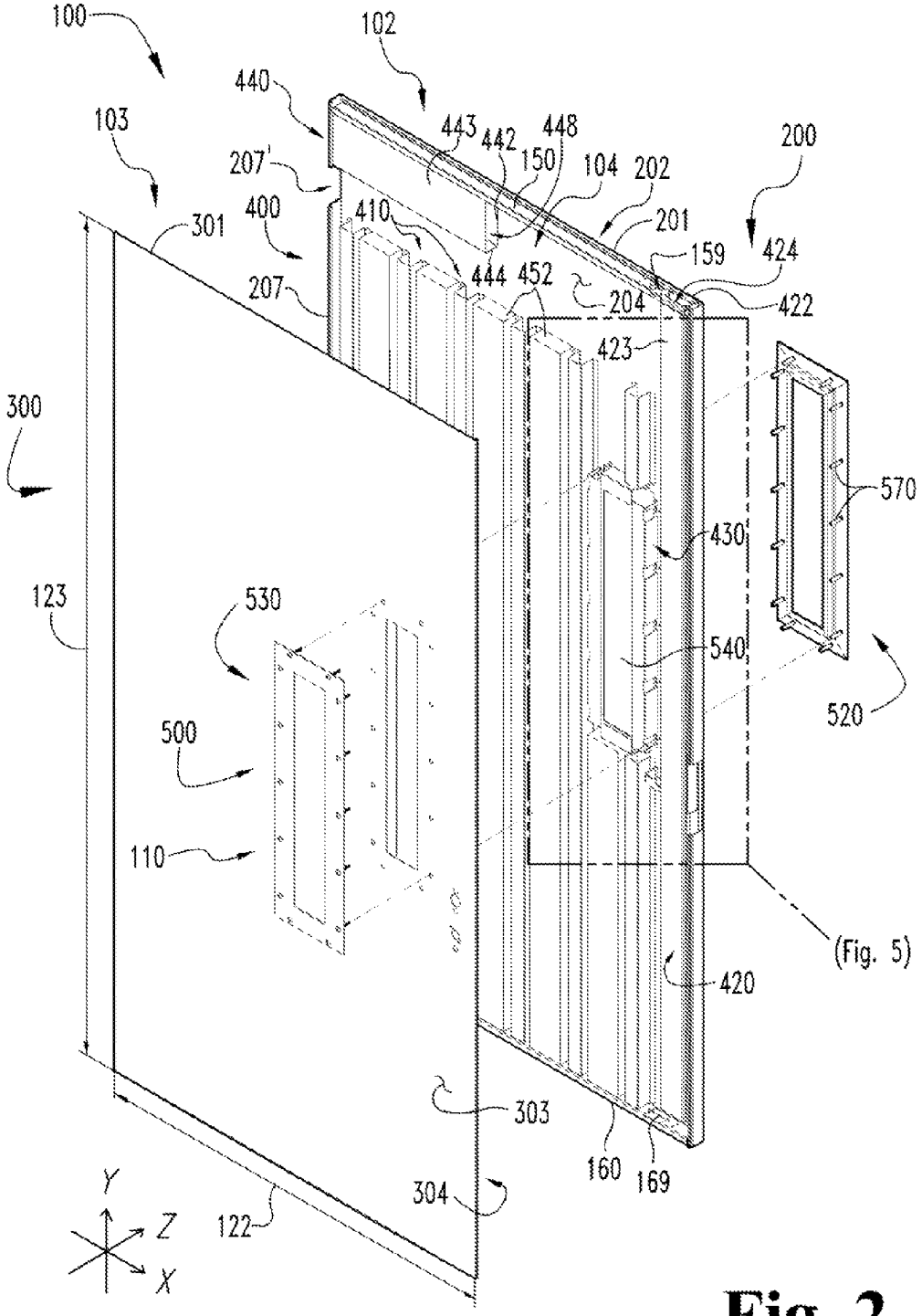
FIG. 2 is an exploded assembly illustration of the door illustrated in FIG. 1.

With additional reference to FIG. 2, the door 100 includes a door body 101, a light 110 having a plurality of dimensional characteristics 120, and a door preparation 130 by which various components of the closure assembly 60 may be mounted to the door body 101. The door body 101 has an exterior or impact side 102 partially defined by an exterior or impact side panel 200, an interior or secure side 103 partially defined by an interior or secure side panel 300, and an internal cavity 104 formed between the exterior and interior panels 200, 300. By way of example, the exterior and interior panels 200, 300 may be formed of a sheet of metal, such as steel. The door body 101 may also include an internal assembly 400 mounted in the internal cavity 104, an upper cover 150 defining a top edge 105 of the door 100, and a lower cover 160 defining a bottom edge 106 of the door 100. As described in further detail below, the door 100 also includes a light assembly 500 which defines the light 110.

With the door 100 in the closed position, the exterior side 102 faces the exterior region 72, the interior side 103 faces the interior region 73, and the cavity 104 is aligned with the wall opening 74. During adverse weather conditions, the exterior side 102 may be struck by flying debris from the exterior region 72, whereas the interior side 103 faces the sheltered or secured interior region 73. Thus, the exterior side 102 may alternatively be referred to as the impact side 102, and the interior side 103 may alternatively be referred to as the secure side 103. The door 100 also includes a plurality of edges, including a top edge 105, a bottom edge 106 opposite the top edge 105, a hinge edge 107, and a swinging edge 108 opposite the hinge edge 107. A plurality of hinges 77 are coupled to the hinge edge 107 and the hinge jamb 87, thereby pivotably mounting the door 100 to the frame 80.

The light 110 has a viewing window 111 which enables users in the interior region 73 to observe conditions in the exterior region 72 while the door 100 is in the closed position. The window 111 has an area A111, a center point 114, and a plurality of sides 115-118 defining an outer perimeter 119 of the window 111. In the illustrated embodiment, the perimeter 119 includes an upper side 115 facing toward the door top edge 105, a lower side 116 facing toward the door bottom edge 106, a laterally inner side 117 facing toward the door hinge edge 107, and a laterally outer side 118 facing toward the door swinging edge 108. In the illustrated form, the upper and lower sides 115, 116 are horizontal, and the laterally inner and laterally outer sides 117, 118 are vertical, such that the window 111 is rectangular. It is to be appreciated, however, that the window 111 may have another geometry, and that the sides thereof may not necessarily be aligned with the horizontal and vertical directions.

The light 110 has a plurality of dimensional characteristics or dimensions 120, including size dimensions 121 relating to the size of the viewing window 111 and positional dimensions 124 relating to the position of the viewing window 111 with reference to the edges of the door 100. More specifically, the size dimensions 121 include a width 122 in a lateral (X) direction and a height 123 in a longitudinal (Y) direction. Additionally, the positional dimensions 124 include an upper positional dimension 125 corresponding to a distance between the door upper edge 105 and the window upper side 115, a lower positional dimension 126 corresponding to a distance between the door bottom edge 106 and the window lower side 116, and a lateral positional dimension 128 corresponding to a distance between the door latch edge or swinging edge 108 and the laterally outer window side 118. In certain forms, one or more of the dimensional characteristics 120 may be selected to comply with industry standards or governmental regulations. For example, the 2010 Standards of the Americans with Disabilities Act (ADA) require that the lower side 116 of a window be located no more than forty-three inches above finished floor (43" AFF). Accordingly, the lower dimension 126 may be selected based upon the ADA standard and the planned clearance between the door bottom edge 106 and the floor 86. By way of example, if the clearance between the bottom edge 106 and the floor 86 is projected to be about ¼ inch, the lower dimension 126 may be selected as about 42¾ inches. In certain forms, the lower dimension 126 may be in the range of 42.7 inches to 42.9 inches.

The latch assembly 90 is mounted to the door 100 in the door preparation 130, and is operable to engage the frame 80 to retain the door 100 in the closed position. The latch assembly 90 includes an exterior actuator 92 mounted on the door exterior side 102, an interior actuator mounted on the door interior side 103, and at least one latch operated by the actuators. More specifically, each latch is mounted adjacent one of the door edges, and has an extended or latching position in which the latch extends beyond the corresponding door edge, and a retracted or unlatching position in which the latch is received in the door cavity 104. The latch assembly 90 has an unlatching state in which each latch is in the unlatching position, and a latching state in which each latch is in the latching position. With the door 100 in the closed position and the latch assembly 90 in the latching state, each latch engages the frame 80 and retains the door 100 in the closed position. With the door 100 in the closed position and the latch assembly 90 in the unlatching state, each latch is disengaged from the frame 80 or is otherwise inoperable to retain the door 100 in the closed position. As will be appreciated, each of the interior actuator 92 and the exterior actuator may be operable to transition the latch assembly 90 from the latching state to the unlatching state, thereby permitting the door 100 to be opened.

Figure 5:
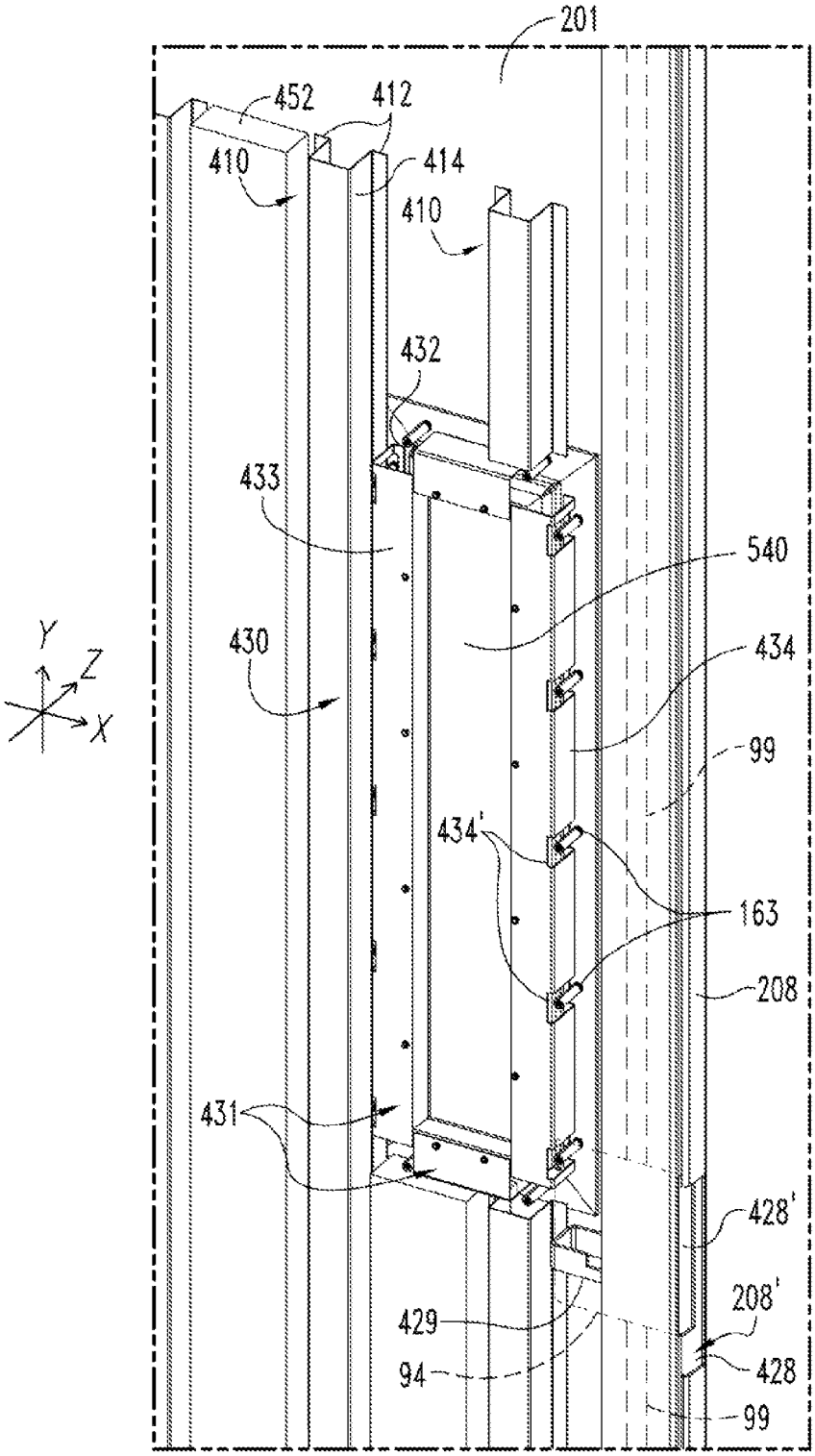
FIG. 5 is a perspective illustration of a portion of a subassembly of the door illustrated in FIG. 2.

In the illustrated form, the latch assembly 90 includes a top latch 95 mounted adjacent the top edge 105 and operable to engage an opening in the top jamb 85 of the frame 80, a bottom latch 96 mounted adjacent the bottom edge 106 and operable to engage an opening in the floor 86, and a center latch 98 mounted adjacent the swinging edge 108 and operable to engage an opening in the latch jamb 88. As illustrated in FIG. 5, the latch assembly 90 may further include a mortise lockset 94 seated in the door cavity 104, and connectors 99 such as rods or cables connecting the mortise lockset 94 to the top and bottom latches 95, 96.

While the latch assembly 90 is illustrated as including a top latch 95, a bottom latch 96, and a center latch 98, it is to be appreciated that alternative configurations are also contemplated. By way of example, the latch assembly 90 may include a deadbolt mounted near the center latch 98, or the center latch 98 may be omitted. Additionally, while the actuator 92 is illustrated in the form of a lever, it is also contemplated that the latch assembly 90 may include another form of actuator, such as a knob or exit device. In certain forms, the latch assembly 90 may be installed on the door 100 during manufacturing such that the door 100 includes the latch assembly 90 at the time of sale to an end user. In other forms, the latch assembly 90 and the door 100 may be provided separately as modular units, and the door 100 may be configured for use with a plurality of different configurations of latch assembly 90.

As noted above, the upper cover 150 defines the door top edge 105, and the lower cover 160 defines the door bottom edge 106. The upper cover 150 may include an opening 159 through which upper latch 95 extends when in the extended position. Similarly, the lower cover 160 may include an opening 169 through which lower latch 96 extends when in the extended position. In the illustrated form, the upper cover 150 and the lower cover 160 are manufactured as separate pieces, and are mounted to the impact side panel 200 during assembly. In other forms, the upper cover 150 and/or the lower cover 160 may be integrally formed with the one of the panels 200, 300, for example by bending the panel to form a flange.

Figure 3:
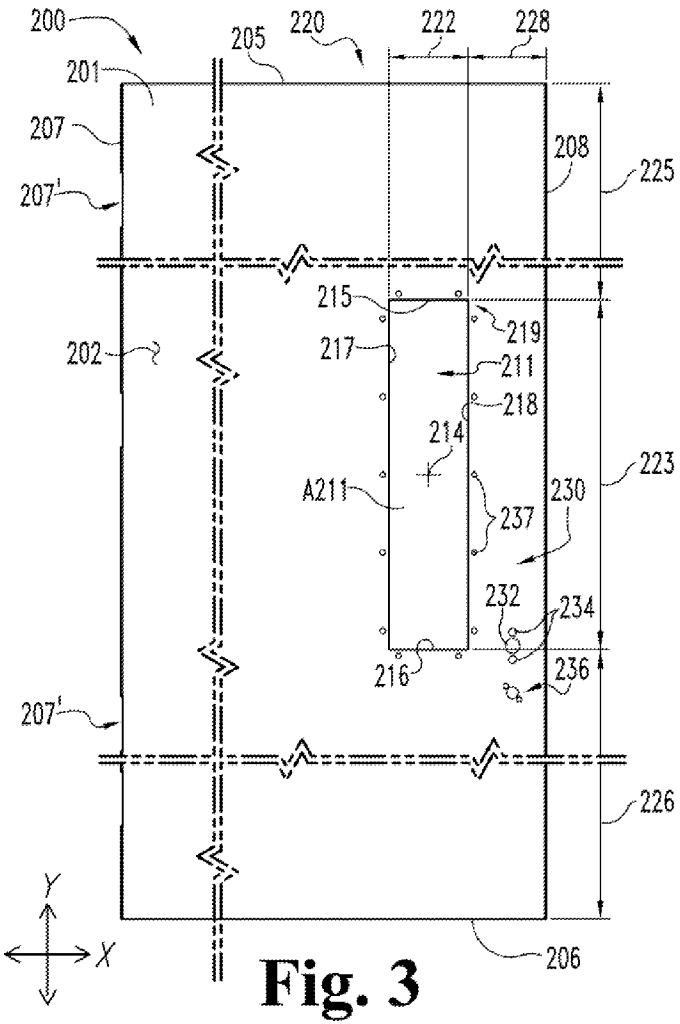
FIG. 3 is a plan view of a first door panel included in the door illustrated in FIG. 2.

With additional reference to FIG. 3, the impact side panel 200 includes an impact side skin 201 having an outward facing surface 202 and an inward facing surface 204. The outward facing surface 202 partially defines the door impact side 102, and the inward facing surface 204 partially defines the internal cavity 104. The panel 200 may further include one or more flanges that extend transversely from the skin 201 and partially define one or more edges of the door 100. In the illustrated form, the panel 200 includes a hinge-side flange 207 which at least partially defines the hinge edge 107 of the door 100 and a latch-side flange 208 which at least partially defines the latch edge 108 of the door 100. The hinge-side flange 207 may include a plurality of cutouts 207', each sized and configured to receive a portion of one of the hinges 77. The swinging-side flange 208 may similarly include a cutout 208' through which the mortise lockset 94 may be inserted into the internal cavity 104.

The impact side panel 200 includes a number of features which correlate to those described above with reference to the door body 101. Unless indicated otherwise, similar reference characters are used to indicate elements and features of the panel 200 which correlate to those described above. For example, the panel 200 includes an opening 211 having an area A211, a center point 214 and a plurality of sides 215-218 defining an outer perimeter 219, which correlate to the area A111, center point 114, sides 115-118, and perimeter 119 of the viewing window 11. Additionally, the skin 201 has a plurality of dimensions 220 correlating to the dimensions 120, such as the dimension 225 between the upper side 215 of the opening 211 and the top edge 205 of the skin 201, which correlates to the dimension 125 between the upper side 115 of the window 111 and the top edge 105 of the door 100. In the interest of conciseness, the following descriptions focus primarily on features of the panel 200 that are different from those described above with regard to the door 100.

At least one of the size dimensions 221 of the impact side panel opening 211 is greater than the corresponding one of the size dimensions 121 of the viewing window 111, such that the area A211 of the opening 211 is greater than the area A111 of the viewing window 111. In the illustrated form, each of the opening width 222 and opening height 223 is greater than the corresponding one of the viewing window width 122 and viewing window height 123. Additionally, the center point 214 of the opening 211 may be aligned with the center point 114 of the window 111, such that each of the positional dimensions 224 of the impact side panel opening 211 (i.e. the dimensions 225, 226, 228) is slightly less than the corresponding one of the positional dimensions 124 of the viewing window 111 (i.e., the dimensions 125, 126, 128).

The impact side panel 200 also includes a panel preparation 230 which partially defines the door preparation 130. The panel preparation 230 includes a plurality of openings operable to receive portions of the latch assembly 90. For example, the impact side actuator 92 may be connected to the mortise lockset 94 through a first opening 232, and may be mounted to the door 100 by mounting bolts which extend through a pair of second openings 234. The preparation 230 may further include a plurality of fastener openings 237 surrounding the main opening 211.

Figure 4:
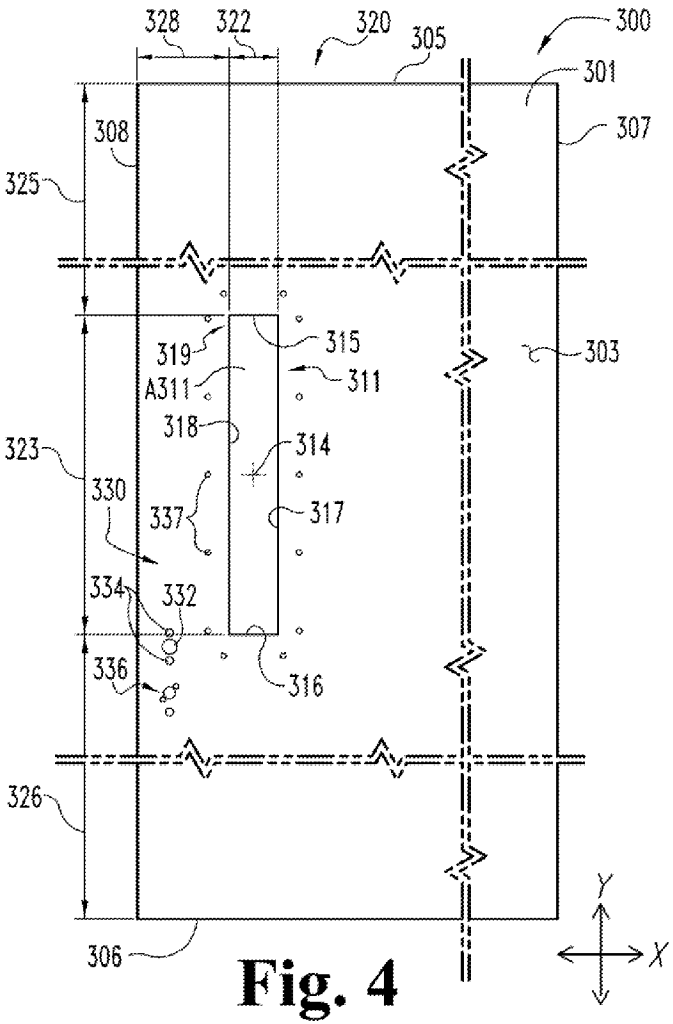
FIG. 4 is a plan view of a second door panel included in the door illustrated in FIG. 2.

With additional reference to FIG. 4, the secure side panel 300 is substantially similar to the impact side panel 200. Unless indicated otherwise, similar reference characters are used to indicate elements and features of the secure side panel 300 which correlate to those described above with reference to the impact side panel 200. In the interest of conciseness, the following descriptions focus primarily on features of the secure side panel 300 that are different from those described above with reference to the impact side panel 200.

In the illustrated form, the size dimensions 321 of the secure side panel opening 311 correspond to the size dimensions 121 of the viewing window 111, such that the area A311 of the opening 311 is substantially equal to the area A111 of the viewing window 111. The center point 314 of the opening 311 may be aligned with the center point 114 of the window 111, such that each of the positional dimensions 324 of the secure side panel opening 311 (i.e. the dimensions 325, 326, 328) is substantially equal to the corresponding one of the positional dimensions 124 of the viewing window 111 (i.e., the dimensions 125, 126, 128). As used herein, the term "substantially equal" may be used to indicate that two dimensions or areas are equal to one another within a margin dictated by manufacturing tolerances and/or required clearances. The center point 314 of the secure side panel opening 311 may additionally be aligned with the center point 214 of the impact side panel opening 211, such that each of the positional dimensions 324 of the secure side panel opening 311 (i.e. the dimensions 325, 326, 328) is slightly less than the corresponding one of the positional dimensions 224 of the impact side panel opening 211 (i.e., the dimensions 225, 226, 228).

With additional reference to FIG. 5, the internal assembly 400 is mounted in the internal cavity 104. In the illustrated embodiment, the internal assembly 400 includes a plurality of stiffeners 410, a channel member 420 mounted adjacent the latch edge 108, a support bracket assembly 430 mounted adjacent the panel openings 211, 311, a pocket member 440 mounted adjacent the upper edge 105 and the hinge edge 107, and insulation strips 450 mounted between the stiffeners 410.

Each stiffener 410 includes a pair of base flanges 412, a body 413, and a pair of arms 414 connecting the base flanges 412 to the body 413. In the illustrated form, the base flanges 412 are coupled to the impact side panel 200, the body 413 is coupled to the secure side panel 300, and the arms 414 extend transversely across the internal cavity 104. In other forms, one or more of the stiffeners 410 may instead be mounted in the cavity 104 such that the base flanges 412 are coupled to the secure side panel 300 and the body 413 is coupled to the impact side panel 200. Additionally, while the stiffeners 410 are illustrated as having a length dimension extending entirely in the longitudinal (Y) direction, it is also contemplated that the length dimensions of the stiffeners 410 may extend entirely in the lateral (X) direction, or in a direction oblique to the longitudinal and lateral directions.

The channel member 420 is mounted adjacent the latch edge 108, and includes a first wall 422 adjacent the impact side panel 200, a second wall 423 adjacent the secure side panel 300, and a third wall 428 adjacent the latch-side flange 208. The first and second walls 422, 423 are transversely offset from one another such that a channel 424 is formed therebetween. The third wall 428 includes an opening 428', and the channel member 420 may further include a bracket 429 aligned with the opening 428'. When the door body 101 is assembled, the opening 428' is aligned with the opening 208' such that the mortise lockset 94 can be inserted into the cavity 104 and supported by the bracket 429. Additionally, the connectors 99 may extend along the channel 424 to connect the lockset 94 with the upper latch 95 and/or lower latch 96.

The bracket assembly 430 includes a plurality of brackets 431, each of which includes a first wall 432 adjacent the impact side panel 200, a second wall 433 adjacent the secure side panel 300, and a transverse wall 434 which connects the first and second walls 432, 433. As described in further detail below, the first wall 432 extends from the transverse wall 434 by a first distance, and the second wall 433 extends from the transverse wall 434 by a second distance greater than the first distance. As described in further detail below, the bracket assembly 430 may include a plurality of transversely-extending fastener slots 437, which may be formed the transverse walls 434 of the vertical or longitudinally-extending brackets 431.

The pocket member 440 is mounted adjacent the upper edge 105 and the hinge edge 107, and includes a first wall 442 adjacent the impact side panel 200, a second wall 443 adjacent the secure side panel 300, and a transverse wall 444 connecting the first and second walls 442, 443. The first and second walls 442, 443 are transversely offset from one another such that an open-faced pocket 448 is formed therebetween. In the illustrated form, the pocket member 440 is provided as a reinforcement bracket configured to provide support for an externally-mounted door closer. Alternatively, the open face of the pocket 448 may be aligned with a cutout in the door upper edge 105, such that an internal closer may be mounted in the pocket member 440.

The insulation strips 450 are mounted in the cavity 104 between the stiffeners 410. The insulation strips 450 may, for example, be formed of a foam or fiberglass insulating material. In certain forms, the insulation strips 450 may provide additional rigidity to the door body 101. While the door 100 is illustrated as including discrete insulation strips 450, it is also contemplated that other forms of insulation may be utilized. For example, foam or another form of insulating filler may be injected into the internal cavity 104 during the manufacturing process.

Figure 6:
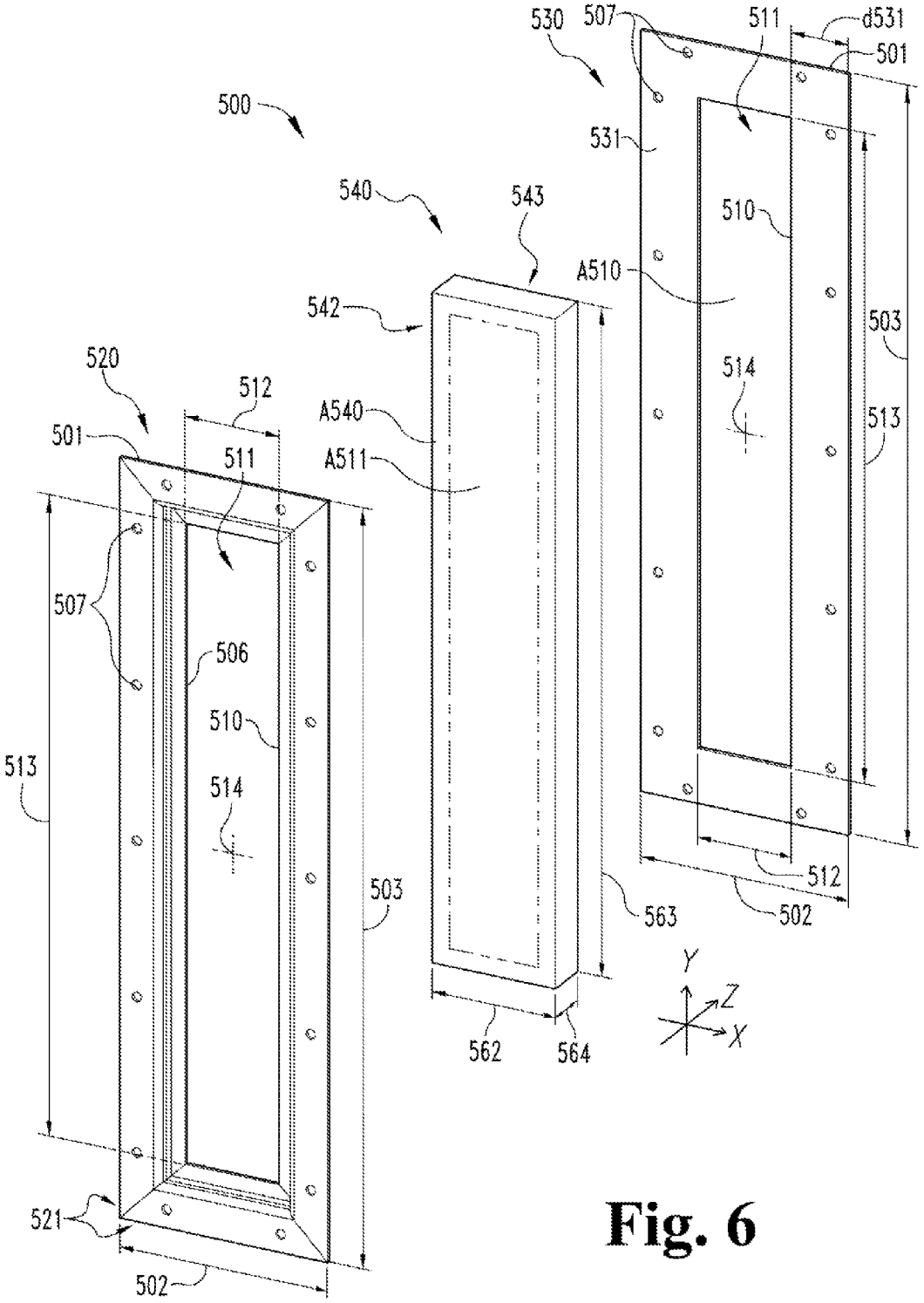
FIG. 6 is an exploded assembly view of a light assembly included in the door illustrated in FIG. 2.

With additional reference to FIG. 6, the light assembly 500 includes an impact side trim 520 mounted to the impact side panel 200, a secure side trim 530 mounted to the secure side panel 300, an impact-resistant pane 540 mounted in the internal cavity 104, and a plurality of fasteners 570 (FIG. 2) coupling the trims 520, 530 to the door body 101. Each of the impact side trim 520 and secure side trim 530 has an inner perimeter 510 which defines a main opening 511 having a center point 514, and an outer perimeter 501 which perimetrically surrounds the inner perimeter 510 about the center point 514. The outer perimeter 501 has a lateral width 502 and a longitudinal height 503, and the inner perimeter 510 defines a main opening 511 having a lateral width 512 and a longitudinal height 513. The width 512 and height 513 of the main openings 511 correspond to the widths 122, 322 and heights 123, 323 of the viewing window 111 and secure side panel opening 311. Each trim 520, 530 may further include a plurality of fastener openings 507 formed near the outer perimeter 501.

As will be appreciated, the terms "outer" and "inner" may be used to describe the relative positions of certain elements or features with reference to a center point. For example, the inner perimeter 501 is closer to the center point 514 than the outer perimeter 510. In certain sets of elements, the outer element may perimetrically surround the inner element with reference to or about a center point. For example, the outer perimeter 510 perimetrically surrounds the inner perimeter 501 with reference to the center point 514. Additionally, while the outer perimeter 501 of the impact side trim 520 is transversely offset from the inner perimeter 510 thereof, the outer perimeter 501 may nonetheless be considered to perimetrically surround the inner perimeter 510 about the center point 514.

In the illustrated form, the secure side trim 530 is formed of a single unitary trim plate which defines the outer perimeter 501, the inner perimeter 510, and the main opening 511 of the secure side trim 530. The trim 530 includes a plurality of planar sections 531, each of which has a width d531 corresponding to the width d521 of the trim plates 521. As described in further detail below, when the impact side trim 520 and secure side trim 530 are installed on the door 100, the fastener openings 507 of the trims 520, 530 are aligned with one another.

Figure 7:
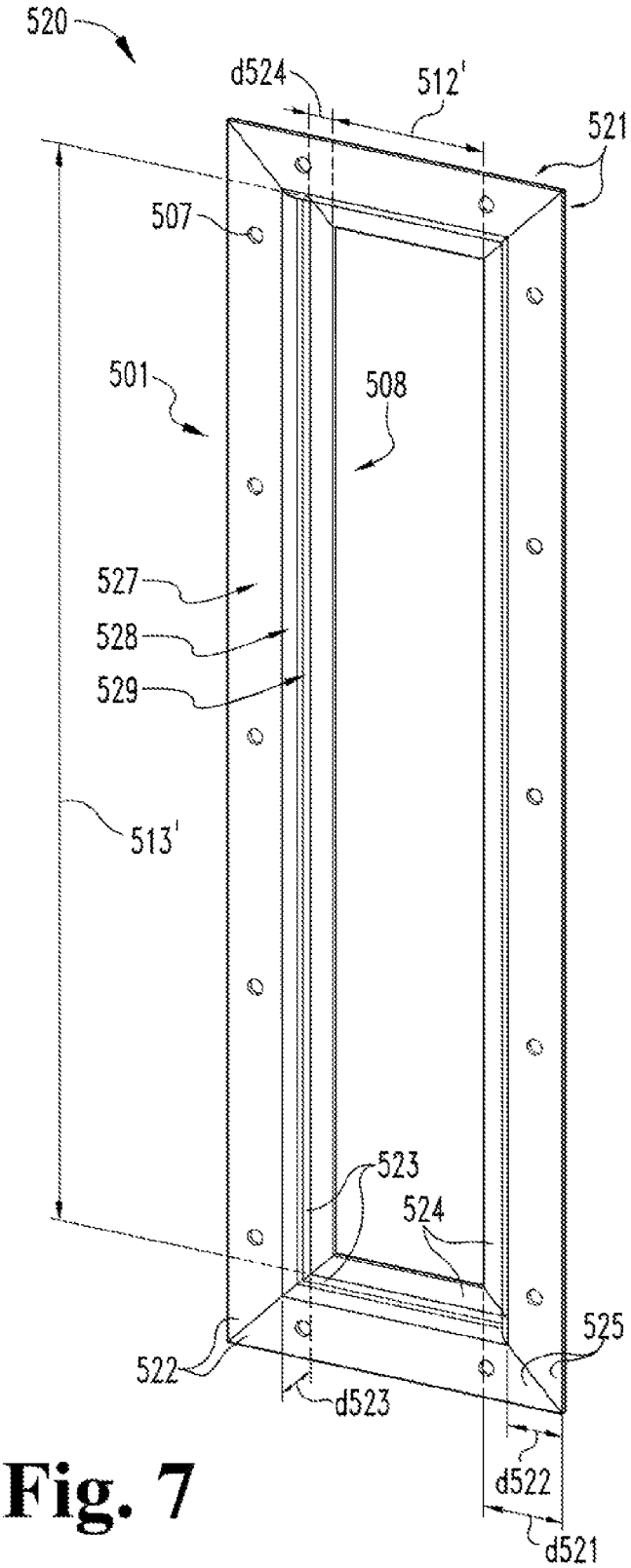
FIG. 7 is a perspective illustration of a trim included in the light assembly illustrated in FIG. 6.

With additional reference to FIG. 7, the impact side trim 520 includes a plurality of trim plates 521. Each trim plate 521 includes an outer strip 522, an inner strip 524, and a transverse strip 523 connecting the outer strip 522 and the inner strip 524. Each trim plate 521 has a width d521, which includes a width d522 of the outer strip 522 and a width d524 of the inner strip 524. Each trim plate 521 also has a transverse depth, which includes a transverse length d523 of the transverse strip 523. The outer strip 522 and inner strip 524 are substantially parallel to one another, and each extends along a lateral-longitudinal (X-Y) plane. Additionally, the outer and inner strips 522, 524 are offset from one another in the transverse (Z) direction, and the transverse strip 523 extends in the transverse (Z) direction to connect the outer and inner strips 522, 524. In the illustrated form, the transverse strip 523 is substantially perpendicular to the outer and inner strips 522, 524, and extends primarily along either a lateral-transverse (X-Z) plane or a longitudinal-transverse (Y-Z) plane. In other embodiments, the transverse strips 523 may extend at an oblique angle with respect to the outer and inner strips 522, 524.

In the illustrated form, each trim plate 521 includes a plurality of fastener openings 507 formed in the outer strip 522, and has mitered ends 525. In certain embodiments, the trim plates 521 may be secured to one another to form the impact side trim 520 prior to mounting the trim 520 on the door body 101. For example, the mitered ends 525 may be welded or otherwise joined during the assembly process, and the assembled trim 520 may be installed on the door body 101. In other embodiments, the trim plates 521 may not necessarily be joined to one another, and the trim 520 may be assembled by independently securing each of the trim plates 521 to the impact side panel 200.

When assembled, the impact side trim 520 includes an outer frame 527 defined by the outer strips 522, an intermediate frame 528 defined by the transverse strips 523, and an inner frame 529 defined by the inner strips 524. The outer frame 527 defines the outer perimeter 501 of the impact side trim 520, and the inner frame 529 defines the inner perimeter 510 and main opening 511 of the impact side trim 520. The intermediate frame 528 has a lateral width 512', which includes the lateral width 512 of the impact side trim opening 511, the widths d524 of two inner strips 524, and the thicknesses of two transverse strips 523. The intermediate frame 528 also has a longitudinal height 513', which includes the longitudinal height 513 of the impact side trim opening 510, the widths d524 of two inner strips 524, and the thicknesses of two transverse strips 523. In other words, each of the width 512' and height 513' of the intermediate frame 528 correspond to the distance between the outer surfaces of two of the transverse strips 523. As described in further detail below, the width 512' and height 513' of the intermediate frame 528 are less than the width 222 and height 223 of the impact side trim opening 211, such that the impact side trim opening 211 is operable to receive the intermediate frame 528.

Figure 8:
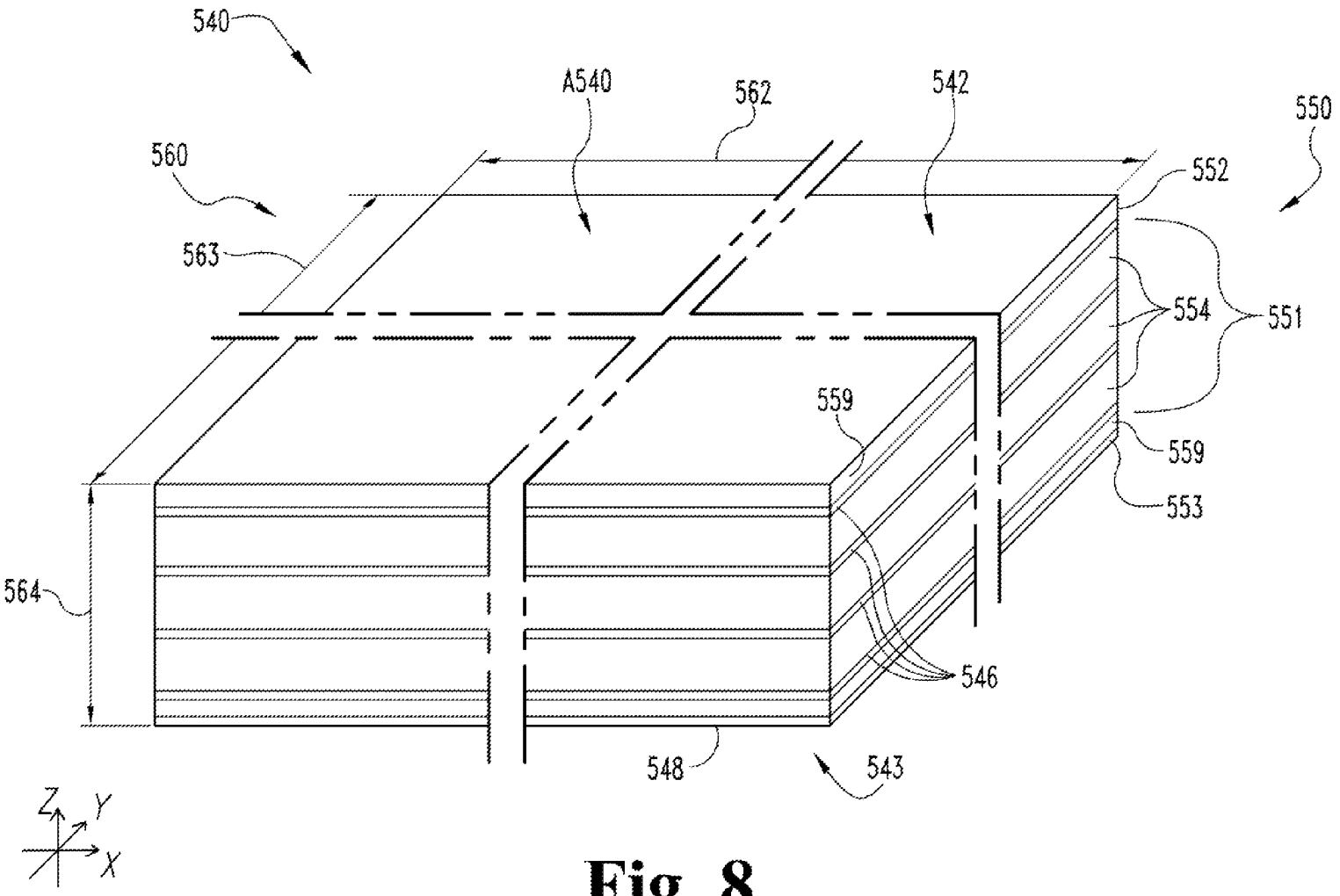
FIG. 8 is a perspective illustration of a pane included in the light assembly illustrated in FIG. 6.

With additional reference to FIG. 8, the pane 540 includes an impact side 542, a secure side 543, and a plurality of layers 550 bound together by an adhesive 546. The layers 550 include a pair of outer layers 551 and at least one inner layer 554 sandwiched between the outer layers 551. While the illustrated pane 540 includes three inner layers 554, it is also contemplated that more or fewer inner layers may be utilized. The pair of outer layers 551 includes an impact side outer layer 552 defining the impact side 542 of the pane 540, and a secure side outer layer 553 defining the secure side 543 of the pane 540. In the illustrated form, each of the outer layers 551 includes a glass layer 559, and the inner layers 554 are formed of a high-strength polycarbonate. The secure side outer layer 553 may further include an anti-spall film 548 which coats the glass layer 559 and defines the secure side 543 of the pane 540.

The pane 540 has a plurality of dimensions 560, including a width 562 in the lateral (X) direction, a height 563 in the longitudinal (Y) direction, and a thickness 564 in the transverse (Z) direction. The pane 540 has a thickness 564 which is less than a transverse thickness 129 of the door 100. By way of example, the door thickness 109 may be about 1.75 inches, and the pane thickness 564 may be about one inch.

Figure 9:
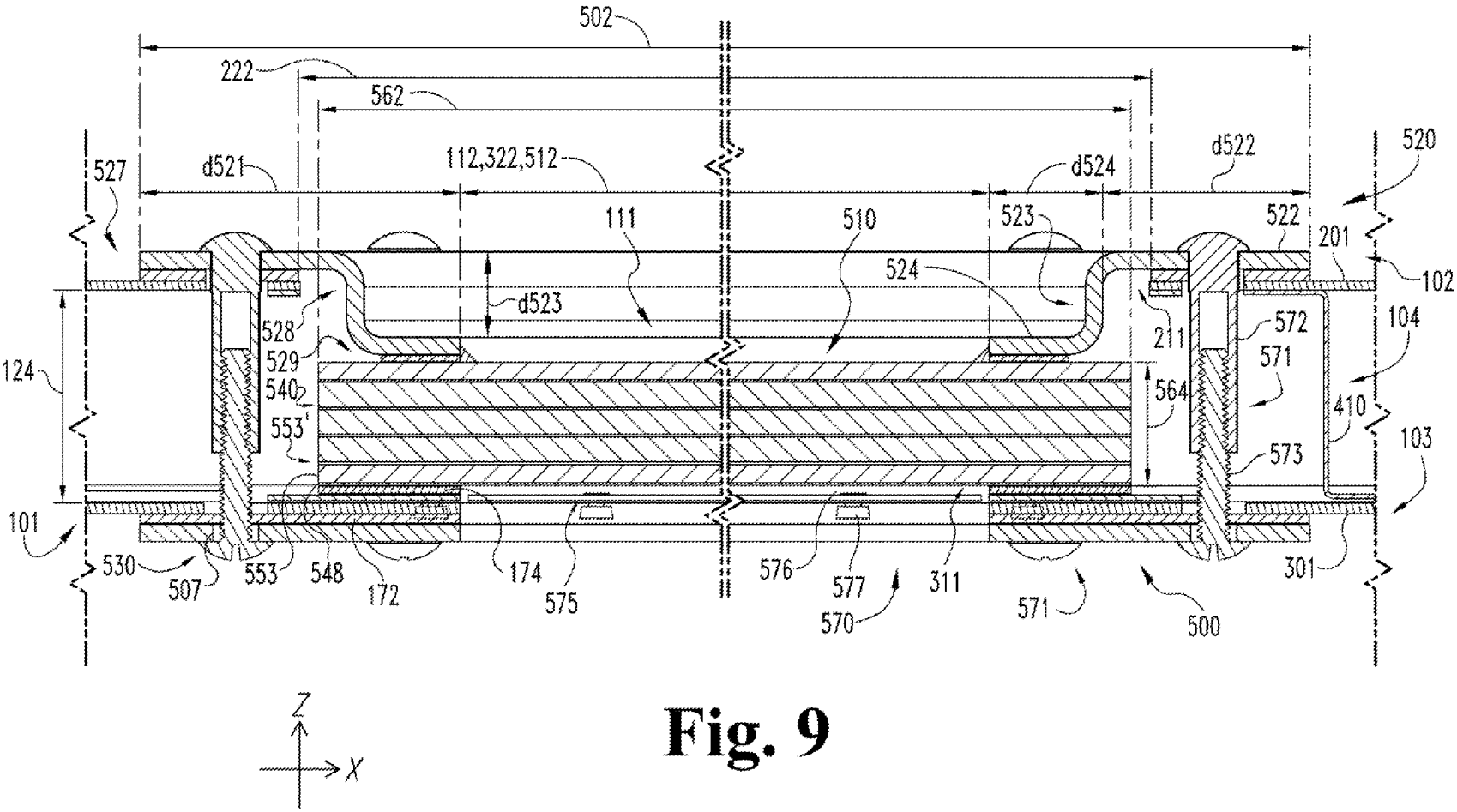
FIG. 9 is a cutaway view of a portion of the door illustrated in FIG. 2.
Figure 10:
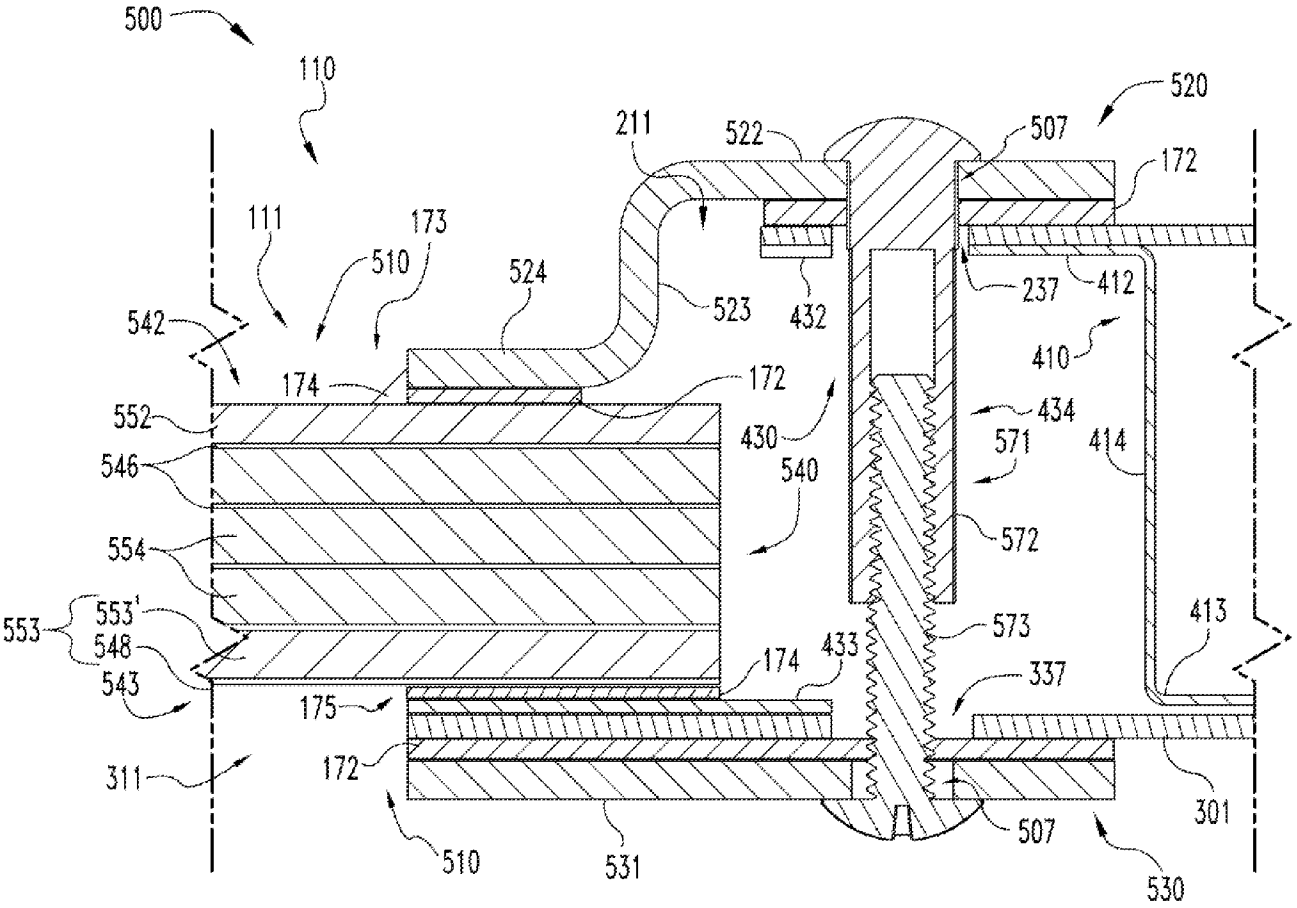
FIG. 10 illustrates a cross-section of a portion of the door at the cutting plane of FIG. 9.

With additional reference to FIGS. 9 and 10, illustrated therein is the light assembly 500 installed on the door body 101. The light assembly 500 is secured to the door body 101 by fasteners 570, the impact side trim 520 is coupled to the impact side panel 200, the secure side trim 530 is coupled to the secure side panel 300, and the pane 540 is mounted in the door cavity 104, and is attached to the door body 101 and the impact side trim 520.

In the impact side trim 520, the outer strips 522 are joined to the impact side skin 201 such that the outer perimeter 501 of the trim 520 perimetrically surrounds the impact side panel opening 211. In the illustrated form, double-sided adhesive tape 172 is sandwiched between the outer strips 522 and the impact side skin 201, thereby adhering the trim 520 to the impact side panel 200. As will be appreciated, the double-sided adhesive tape 172 may be provided as a single strip or as multiple strips. Additionally, as used herein, the term "double-sided adhesive tape" indicates that the tape 172 has a first adhesive side and second adhesive side opposite the first adhesive side. In certain forms, the tape 172 may further include a closed cell foam positioned between the first and second adhesive sides, and the first and second adhesive sides may comprise a very high bond adhesive. As one example, the tape 172 may be 3M™ VHB™ Tape available from 3M™ of Maplewood, Minn.

The transverse strips 523 extend transversely from the inner sides of the outer strips 522 such that the intermediate frame 528 extends through the impact side skin opening 211 and is surrounded by the perimeter 219 of the opening 211. The inner strips 524 extend inwardly from the transverse strips 523 such that the inner frame 529 and the impact side frame opening 510 are positioned in the door internal cavity 104. The inner strips 524 are adhered to the impact side 542 of the pane 540, for example by a layer of double-sided adhesive tape 172 sandwiched between the inner frame 529 and the pane 540. A bead 173 of glazing material 174 may be applied along the inner perimeter 510 of the trim 520 to form a waterproof seal. By way of example, the glazing material 174 may be provided in the form of an elastomeric sealant.

The secure side trim 530 is joined to the secure side skin 301 such that the outer perimeter 501 of the trim 530 perimetrically surrounds the secure side panel opening 311 and the trim opening 511 is aligned with the panel opening 311. In the illustrated form, double-sided adhesive tape 172 is sandwiched between the planar sections 531 and the secure side skin 301, thereby adhering the trim 530 to the impact side panel 200.

As noted above, the pane 540 is mounted in the door cavity 104, and the impact side 542 of the pane 540 is adhered to the impact side trim 520. Additionally, the secure side 543 of the pane 540 is adhered to the door body 101 by a bed 175 of glazing material 174. In the illustrated form, the glazing material bed 175 is sandwiched between the anti-spall film 548 and the wide second walls 433 of the brackets 431 such that the pane 540 is indirectly attached to the secure side panel 300 via the bracket assembly 430. In other embodiments, the glazing material bed 175 may be sandwiched between the pane secure side 543 and the secure side skin 301 such that the pane 540 is directly attached to the secure side panel 300.

In addition to the adhesive bonding provided by the double-sided adhesive tape 172 and glazing material 174, the light assembly 500 is also secured to the door body 101 by a plurality of fasteners 570. In the illustrated form, the fasteners are provided in the form of sex bolts 571, each of which includes an internally-threaded female lug 572 and an externally threaded male bolt 573. The fastener openings 507 of the trims 520, 530 are aligned with the fastener openings 237, 337 of the panels 200, 300 and the slots 437 of the bracket assembly 430, and each female lug 572 is threadedly engaged with a corresponding one of the male bolts 573 within a corresponding one of the slots 437.

Figure 11:
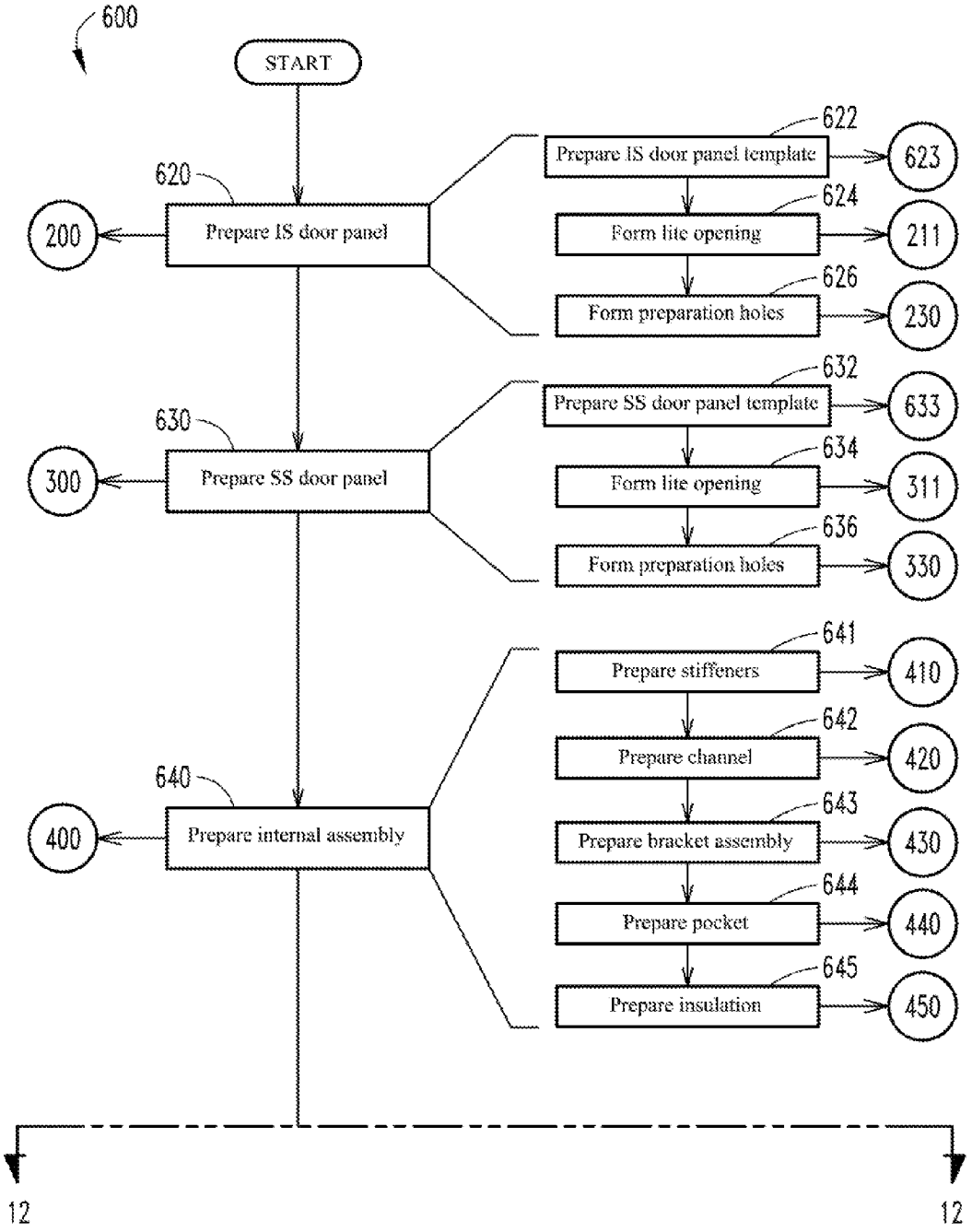
FIGS. 11 and 12 are schematic flow diagrams of a process according to one embodiment.
Figure 12:
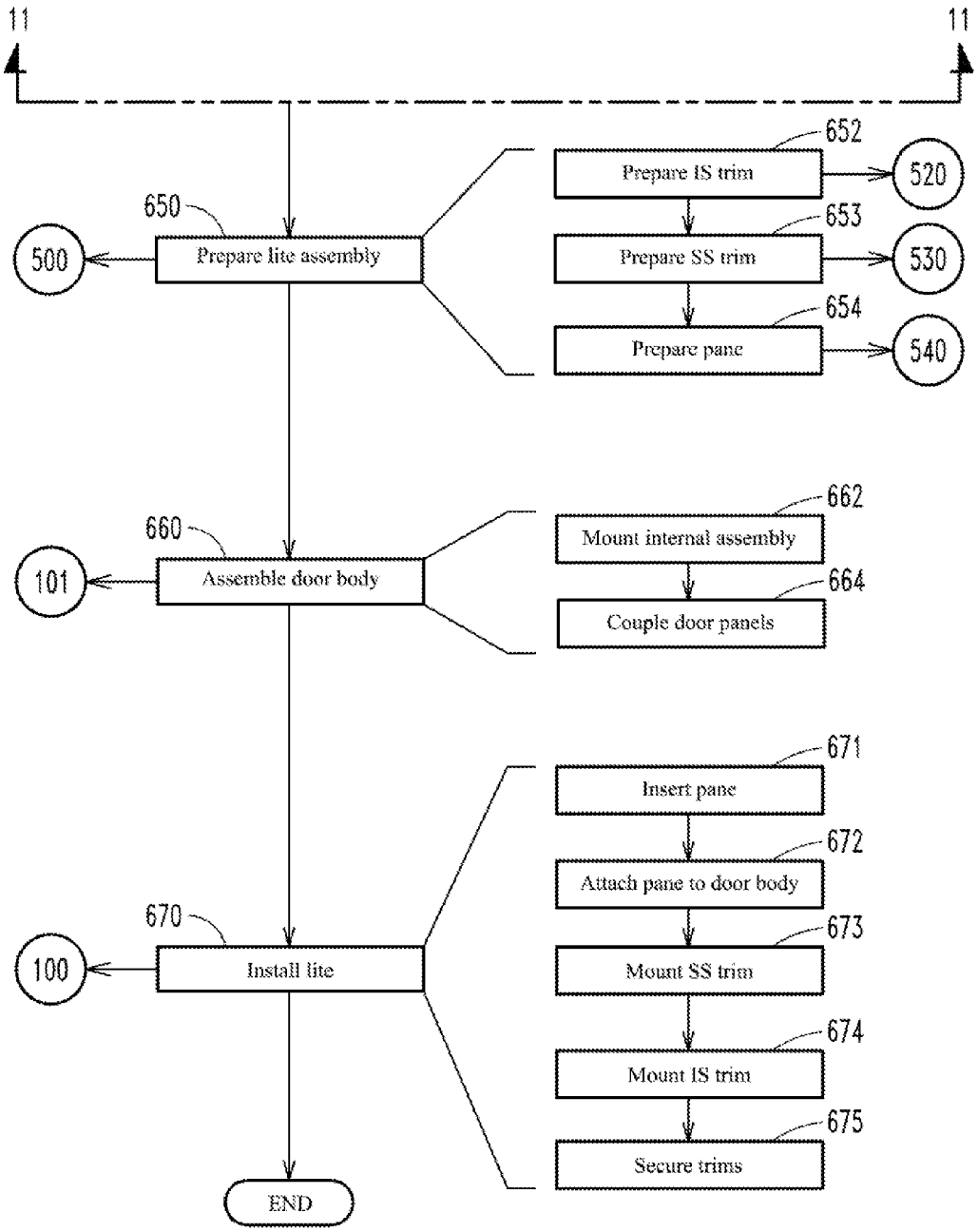

With additional reference to FIGS. 11 and 12, an exemplary process 600 which may be performed to manufacture the door 100 is illustrated. Operations illustrated for the processes in the present application are understood to be examples only, and operations may be combined or divided, and added or removed, as well as re-ordered in whole or in part, unless explicitly stated to the contrary.

The process 600 includes a procedure 620, which generally involves preparing the impact side door panel 200. More specifically, the procedure 620 includes an operation 622, which includes preparing an impact side panel template 623 having the general form of the impact side panel 200. For example, the operation 622 may include cutting the template 623 from a larger sheet of metal. The procedure 620 also includes an operation 624, which includes forming the impact side opening 211 in the panel template 623. More specifically, the operation 624 includes forming the opening 211 such that when the procedure 620 is complete, the opening 211 has the desired dimensions 220. The procedure 620 may also include an operation 626, which includes forming the impact side panel preparation 230. For example, the operation 626 may include forming the openings 207', 208', mounting holes 232, 234, 236 and/or fastener holes 237 at predetermined locations on the template 623. The procedure 620 may further include an operation 628, which includes forming the flanges 207, 208 which define the hinged edge 107 and swinging edge 108 of the door 100. In certain forms, the operation 622 may include forming the impact side panel template 623 with a lateral width corresponding to the lateral width of the door 100 plus twice the door thickness 129, and bending or stamping the template 623 to form the flanges 207, 208.

The process 600 includes a procedure 630, which generally involves preparing the secure side door panel 300. More specifically, the procedure 630 includes an operation 632, which includes preparing a secure side panel template 633 having the general form of the secure side panel 300. For example, the operation 632 may include cutting the template 633 from a larger sheet of metal. The procedure 630 also includes an operation 634, which includes forming the secure side opening 311 in the panel template 633. More specifically, the operation 634 includes forming the opening 311 such that when the procedure 630 is complete, the opening 311 has the desired dimensions 320. The procedure 630 also includes an operation 636, which includes forming the secure side panel preparation 330. For example, the operation 636 may include forming mounting holes 332, 334, 336 and/or fastener holes 337 at predetermined locations on the template 633.

The process 600 also includes a procedure 640, which generally involves preparing the internal assembly 400. The procedure 640 may include an operation 641 which involves preparing the stiffeners 410, an operation 642 which involves preparing the channel member 420, an operation 643 which involves preparing the bracket assembly 430 and/or an operation 644 which involves preparing the pocket member 440. For example, one or more of the operations 641-643 may include stamping or otherwise bending one or more pieces of sheet metal to form the stiffeners 410, channel member 420, bracket assembly 430, and/or pocket member 440. The procedure 640 may also include an operation 645, which involves preparing the insulation 450. For example, the operation 645 may include cutting one or more insulation sheets into strips, or preparing a foam or other form of insulation to be injected or sprayed into the cavity 104.

The process 600 also includes a procedure 650, which generally involves preparing the light assembly 500. The procedure 650 includes an operation 652, which involves preparing the impact side trim 520. For example, the operation 652 may involve cutting, stamping, and/or bending one or more pieces of sheet metal to form the trim plates 521. The operation 652 may further include welding or otherwise joining the trim plates 521 to form the impact side trim 520. The procedure 650 also includes an operation 653, which involves preparing the secure side trim 530. For example, the operation 653 may include cutting or stamping a piece of sheet metal to form the secure side trim 530. The procedure 650 also includes an operation 654, which involves preparing the pane 540, for example by cutting the pane 540 to the desired dimensions 560. In certain embodiments, the operation 654 may involve adhering the layers 550 to one another and/or applying the anti-spall film 548. In other embodiments, the pane 540 may be procured from a supplier.

The process 600 also includes a procedure 660, which generally involves assembling the door body 101. The procedure 660 includes an operation 662, which involves mounting the internal assembly 400 to one or both of the panels 200, 300. In the illustrated form, the operation 662 includes mounting the bracket assembly 430 to the impact side panel 200 such that the bracket assembly 430 generally surrounds the impact side panel opening 211. For example, the operation 662 may include aligning the edge of each of the shorter walls 432 with a corresponding edge of the impact side panel opening 211, and securing the brackets 431 to the impact side panel 200 with rivets 575. The operation 662 may further include mounting the stiffeners 410, channel 420, pocket 440, and/or insulation strips 450 to the impact side panel 200, for example using one or more of fasteners, welding, and/or adhesives.

The procedure 660 also includes an operation 664, which includes coupling the door panels 200, 300 to one another. By way of example, the operation 664 may include welding the edges of secure side panel 300 to the flanges 207, 208. The operation 664 may also include installing the covers 150, 160 and/or attaching the secure side panel 300 to one or more components of internal assembly 400. In the illustrated form, the operation 664 includes securing the secure side panel 300 to bracket assembly 430 with rivets which pass through the long arms 433 such that the long arms 433 surround the secure side panel opening 311. The operation 664 may also include securing the stiffeners 410, channel 420, pocket 440, and/or insulation strips 450 to the secure side panel 300, for example using one or more of fasteners, welding, adhesives, or the like.

In the illustrated form, the operation 662 involves mounting each component of the internal assembly 400 to the impact side panel 200. It is also contemplated that one or more components of the internal assembly 400 may be mounted to the secure side panel 300. In such forms, the operation 664 may include securing one or more of the components mounted to the secure side panel 300 to the impact side panel 200.

The process 600 also includes a procedure 670, which generally involves installing the light assembly 500 to the assembled door body 101. The procedure 670 includes an operation 671, which includes inserting the pane 540 into the internal cavity 104. More specifically, the operation 671 includes inserting the pane 540 through the impact side panel opening 211. Due to the fact that the dimensions of the opening 211 are greater than the dimensions of the pane 540, the pane 540 can be inserted into the internal cavity 104 via the impact side panel opening 211.

The procedure 670 also includes an operation 672, which includes attaching the pane 540 to the door body 101. In the illustrated form, the operation 672 includes attaching the secure side surface 543 of the pane 540 to the longer arms 433 of the bracket assembly 430 using a glazing material 174. In certain forms, the operation 672 may include applying a bed 175 of the glazing material 174 to the longer arms 433 and/or the outer periphery of the secure side surface 542. In certain forms, the glazing material bed 175 may be applied to the pane 540 and/or longer arms 432 prior to inserting the pane 540 in the operation 671.

The procedure 670 further includes an operation 673, which includes mounting the impact side trim 520 to the impact side panel 200. In the illustrated form, the operation 673 includes adhering the outer frame 527 to the outer face of the impact side panel 200 using double-sided tape 172. For example, one or more first strips or pieces 176 of the tape 172 may be placed between the outer frame 527 and the outer surface of the impact side panel 200. The operation 673 may further include attaching the impact side trim 520 to the impact side surface 542 of the pane 540. For example, one or more second pieces 176 of the tape 172 may be placed between the inner frame 529 and the impact side surface 542 of the pane 540. With the impact side trim 520 mounted to the impact side panel 200, the outer perimeter 501 of the impact side trim 520 perimetrically surrounds impact side panel opening 211, the intermediate frame 528 extends through impact side panel opening 211, the inner frame 529 is received within internal cavity 104, and the opening 511 is aligned with the secure side panel opening 311. As will be appreciated, the operation 673 may include inserting the intermediate frame 528 into the impact side panel opening 211 in order to achieve this configuration.

The procedure 670 also includes an operation 674, which involves mounting the secure side trim 530 to the secure side panel 300 with the trim opening 511 aligned with the panel opening 311. For example, the operation 674 may include adhering the secure side trim 530 to the secure side panel 300 using additional strips of the double-sided adhesive tape 172. With the trims mounted, the fastener openings 507 in the impact side trim 520 and the secure side trim 530 are aligned with one another. Additionally, each of the fastener slots 437 in the bracket assembly 430 is aligned with a corresponding pair of the fastener openings 507. In embodiments in which the panels 200, 300 include the fastener openings 237, 337, the trim fastener openings 507 and fastener slots 437 are also aligned with the panel fastener openings 237, 337.

The procedure 670 also includes operation 675, which involves securing the light assembly 500 to the door body 101 using the fasteners 571. In the illustrated form, the operation 675 involves inserting each of the female lugs 572 into the internal cavity 104 via the fastener openings 507 in the impact side trim 520 and the impact side panel fastener openings 237, inserting each of the male bolts 573 into the internal cavity 104 via the fastener openings 507 in the secure side trim 530 and the secure side panel fastener openings 337, and threadedly engaging each of the male bolts 573 with the corresponding one of the female lugs 572. It is to be appreciated that one or more of the female lugs 572 may instead be inserted from the secure side 103, and the corresponding male bolts 573 may be inserted from the impact side 102. Additionally, at least some of the fasteners 571 may be received in the fastener slots 437 with the female lug 572 and male bolt 572 threadedly engaged within the slot.

With the light assembly 500 installed, the process 600 may be complete, and the assembled door 100 may be ready for shipment. In other forms, the process 600 may further include installing additional features, such as the latching assembly 90 or an internal closer, prior to shipment.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A door, comprising:

a door body defining an impact side, a secure side, a plurality of edges, and an internal cavity, the door body having a longitudinal height, a lateral width, and a transverse thickness, the door body comprising:

an impact side door panel defining the impact side of the door body, the impact side door panel defining an impact side panel opening having an impact side panel opening area;

a secure side door panel defining the secure side of the door body, the secure side door panel defining a secure side panel opening having a secure side panel opening area less than the impact side panel opening area;

wherein the impact side door panel is transversely offset from the secure side door panel and the internal cavity is formed therebetween; and wherein the impact side panel opening is aligned with the secure side panel opening; and a light assembly mounted to the door body, the light assembly comprising:

an impact side trim mounted to the impact side door panel, the impact side trim including an outer frame coupled to the impact side door panel, an intermediate frame extending transversely through the impact side panel opening, and an inner frame positioned in the internal cavity, wherein the inner frame defines an impact side trim opening aligned with the secure side panel opening;

a secure side trim mounted to the secure side door panel, the secure side trim including a secure side trim opening aligned with the secure side panel opening;

an impact-resistant pane positioned in the door cavity, the pane having a pane area greater than the secure side panel opening area, the pane comprising a plurality of layers adhered to one another, wherein the plurality of layers comprises an impact side outer layer adhered to the inner frame of the impact side trim, a secure side outer layer adhered to the door body, and at least one intermediate layer located between the first outer layer and the second outer layer; and a plurality of fasteners coupling the impact side trim and the secure side trim to the door body.

2. The door of claim 1, wherein each of the layers of the pane has the pane area.

3. The door of claim 1, wherein the impact side outer layer is adhered to the inner frame of the impact side trim by a first adhesive device, and the secure side outer layer is adhered to the door body by a second adhesive device different from the first adhesive device.

4. The door of claim 3, wherein the first adhesive device comprises at least one first strip of a double-sided adhesive tape, and wherein the second adhesive device comprises at least one bed of a glazing material.

5. The door of claim 4, wherein the double-sided adhesive tape comprises a foam having a first adhesive side and a second adhesive side.

6. The door of claim 4, further comprising at least one second strip of the double-sided adhesive tape adhering the impact side trim to the impact side panel, and at least one third strip of the double-sided adhesive tape adhering the secure side trim to the secure side panel.

7. The door of claim 4, further comprising at least one bead of the glazing material forming a seal between an inner edge of the impact side trim opening and the impact side outer layer of the pane.

8. The door of claim 4, wherein the secure side outer layer further comprises an anti-spall film formed on the glass layer of the secure side outer layer, and wherein the at least one bed of glazing material is adhered to the anti-spall film.

9. The door of claim 1, wherein the door body further comprises a bracket assembly including a plurality of brackets; wherein each bracket comprises a base portion, a first flange extending from the base portion by a first distance, and second flange extending from the base portion by a second distance greater than the first distance; wherein the first flanges are coupled to the impact side door panel and at least partially surround the impact side panel opening; and wherein the second flanges are coupled to the secure side door panel and at least partially surround the secure side panel opening.

10. The door of claim 9, wherein the secure side outer layer is adhered to the second flanges.

11. The door of claim 9, wherein the bracket assembly further comprises a plurality of slots, wherein each of the slots is formed in one of the base portions, and wherein a corresponding one of the fasteners extends through each of the slots.

12. The door of claim 11, wherein each of the fasteners comprises a sex bolt having a male bolt and a female bolt threadedly engaged with the male bolt within a corresponding one of the slots.

13. The door of claim 1, wherein a distance between a lower edge of the secure side panel opening and a bottom edge of the door body is no greater than 43 inches.

14. The door of claim 1, wherein the pane area is less than the impact side panel opening area.

15. The door of claim 1, wherein each of the impact side outer layer and the secure side outer layer comprises a glass layer, and wherein the at least one intermediate layer comprises a polycarbonate layer.

16. A method, comprising:

preparing a door body including a first door panel, a second door panel, and an internal cavity formed between the first door panel and the second door panel, wherein the first door panel includes a first panel opening having a first panel opening area, wherein the second panel includes a second panel opening having a second panel opening area greater than the first panel opening area, and wherein the second panel opening is aligned with the first panel opening;

preparing a light assembly, wherein preparing the light assembly includes:

preparing a first trim including a first trim opening having a first trim opening area corresponding to the first panel opening area;

preparing a second trim including a second trim opening area corresponding to the first trim opening area, wherein the second trim includes an outer frame, an inner frame defining the second trim opening, and an intermediate frame sized and configured to be received in the second panel opening;

preparing an impact-resistant pane having a pane area greater than the first panel opening area, the pane comprising a plurality of layers adhered to one another, wherein the plurality of layers comprises a first outer layer, a second outer layer, and at least one intermediate layer located between the first outer layer and the second outer layer, wherein each of the first outer layer and the second outer layer comprises a glass layer, and wherein each of the at least one intermediate layers comprises a polycarbonate layer;

mounting the light assembly to the door body, wherein mounting the light assembly to the door body comprises:

inserting the pane into the door cavity through the second panel opening;

adhering the first outer layer of the pane to the door body with a first adhesive device; and adhering the second outer layer of the pane to the inner frame of the second trim with a second adhesive device; and securing the mounted light assembly to the door body, wherein securing the light assembly to the door body comprises securing the first trim and the second trim to the door body with a plurality of fasteners.

17. The method of claim 16, wherein mounting the light assembly to the door body further comprises adhering the first trim to the first door panel, inserting the intermediate frame of the second trim through the second panel opening, and securing the outer frame of the second trim to the second panel.

18. The method of claim 16, further comprising preparing a bracket assembly including a plurality of brackets, wherein each bracket comprises a central portion, a first flange extending from the central portion by a first distance, and a second flange extending from the central portion by a second distance less than the first distance;

wherein preparing the door body includes coupling the bracket assembly to the door body such that the first flanges at least partially surround the first door panel opening; and wherein adhering the first outer layer of the pane to the door body with the first adhesive device includes adhering the first outer layer of the pane to the first flanges with the first adhesive device.

19. The method of claim 18, wherein each of the fasteners comprises a sex bolt including a male bolt and a female bolt, wherein the bracket assembly further comprises a plurality of slots, wherein each slot is formed in the central portion of one of the brackets, and wherein securing the first trim and the second trim to the door body with a plurality of fasteners includes threadedly engaging the male bolts with the female bolts within the slots.

20. The method of claim 19, wherein the outer frame of the first trim comprises a plurality of first fastener openings, wherein the second trim comprises a plurality of second fastener openings, wherein the bracket assembly further comprises a plurality of fastener slots, wherein each fastener slot is formed in the central portion of one of the brackets and is aligned with one of the first fastener openings and one of the second fastener openings, and wherein securing the first trim and the second trim to the door body with a plurality of fasteners includes inserting a first fastener portion into a corresponding one of the fastener slots via a corresponding one of the first fastener openings, inserting a second fastener portion into a corresponding one of the fastener slots via a corresponding one of the second fastener openings, and threadedly engaging the first fastener portions with the second fastener portions within the fastener slots.

21. The method of claim 18, wherein each fastener comprises a sex bolt, wherein each first fastener portion comprises one of an externally threaded bolt and an internally threaded lug, and wherein each second fastener portion comprises the other of an externally threaded bolt and an internally threaded lug.

22. The method of claim 18, wherein the first adhesive device comprises a glazing material, and wherein the second adhesive device comprises a double-sided adhesive tape.

23. The method of claim 22, wherein the double-sided adhesive tape comprises a first adhesive side, an opposite second adhesive side, and a foam located between the first and second adhesive sides, wherein each of the first and second adhesive sides comprises a very high bond (VHB) adhesive, and wherein the glazing comprises an elastomeric sealant.

* * * * *